US006089995A

United States Patent [19]

Schroeder

[11] Patent Number: 6,089,995

[45] Date of Patent: Jul. 18, 2000

[54] SPLIT COLLAR FOR SPORT NETS

[75] Inventor: Edward A. Schroeder, Marengo, Ill.

[73] Assignee: Porter Athletic Equipment Company, Broadview, Ill.

[21] Appl. No.: 09/168,964

[22] Filed: Oct. 9, 1998

[51] Int. Cl.[7] ..... A63B 61/00; A63B 63/00

[52] U.S. Cl. ..... 473/469; 469/490

[58] Field of Search ..... 473/469, 492, 473/466, 493, 494, 416, 482, 17; 403/261, 53, 55, 59, 61, 63; 208/35

[56] References Cited

U.S. PATENT DOCUMENTS

| | | | |
|---|---|---|---|
| 1,263,560 | 4/1918 | Kaufmann | 248/278.1 |
| 1,495,821 | 5/1924 | Tull | 472/77 |
| 2,301,230 | 11/1942 | Smith | 248/661 |
| 2,638,346 | 5/1953 | Stapleton . | |
| 2,958,528 | 11/1960 | Wikelund . | |
| 2,961,236 | 11/1960 | Murphy . | |
| 3,065,964 | 11/1962 | Barnes . | |
| 3,105,682 | 10/1963 | Ahrens | 482/17 |
| 3,561,759 | 2/1971 | Duganich . | |
| 3,740,023 | 6/1973 | Bruggeman | 256/24 |
| 3,940,139 | 2/1976 | Barnes . | |
| 4,153,247 | 5/1979 | Burns . | |
| 4,968,042 | 11/1990 | Stewart . | |
| 5,215,310 | 6/1993 | Allbright . | |
| 5,308,085 | 5/1994 | Koole . | |
| 5,326,109 | 7/1994 | Robl . | |
| 5,393,051 | 2/1995 | Merino et al. . | |
| 5,855,527 | 1/1999 | Koole . | |

OTHER PUBLICATIONS

Quick Set, "Custom Built" Retractable Volleyball System, Designed, Manufactured and Installed by Quik Set Industries, Ozawkie, KS.

Volleyball, 1998 Porter Athletic Equipment Company, CATG 00098 VBC.

*Primary Examiner*—Jeanette Chapman
*Assistant Examiner*—M. Chambers
*Attorney, Agent, or Firm*—Barnes & Thornburg

[57] ABSTRACT

A unique sleeve which is capable of supporting two adjacent nets on a single standard or pole at the same height above the ground as well as being adjustable to different heights relative to each other. The standard system includes a pole and a pair of sleeves on the pole having opposed surfaces when adjacent. A lock on each sleeve locks the sleeve at a vertical position on the pole and net surfaces are provided on each sleeve. The opposing surfaces of the sleeves are shaped so that the net support surfaces are substantially planar when the opposing surfaces are adjacent to each other.

19 Claims, 3 Drawing Sheets

SPLIT COLLAR FOR SPORT NETS

BACKGROUND AND SUMMARY OF THE INVENTION

The present invention relates generally to a standards for nets and more specifically to a standards for a pair of adjacent nets sharing a common pole.

If two nets are provided adjacent each other on a field or in a gymnasium, they have to have separate standards or poles in order for them to have the same height above the ground as well as being adjustable to different heights relative to each other. This increases the cost of the system because two adjacent poles are needed.

A common center pole which is capable of adjusting the height of two adjacent nets to a plurality of common heights are illustrated in FIGS. 7 and 8. FIG. 7 shows a telescopic pole having a common pulley for the lines 11. This system is available from Porter Athletic Equipment Company, Model Nos. 992 and 1992. A common adjustable sleeve of FIG. 8 is also available from Porter Athletic Equipment Company, Model Nos. 852 and 942. A portable system for volleyball, badminton and tennis, which includes a channel with adjustable pressure lock tie offs, is available from Porter Athletic Equipment Company as Model No. 581.

The present invention alleviates this problem by providing a unique sleeve which is capable of supporting two adjacent nets on a single standard or pole at the same height above the ground as well as being adjustable to different heights relative to each other. The standard system includes a pole and a pair of sleeves on the pole having opposed surfaces when adjacent. A lock on each sleeve locks the sleeve at a vertical position on the pole and net surfaces are provided on each sleeve. The opposing surfaces of the sleeves are shaped so that the net support surfaces are substantially planar when the opposing surfaces are adjacent to each other. The opposing surfaces are complements. They may be at a common angle with respect to the axis of the pole and this angle may be in the range of 30–60° or 90°. The opposing surface can also include a plurality of complementing segments.

An arm couples the net support surface to the sleeve. The arm may extend transverse to the axis of the pole. The arm may include a portion which extends parallel to the pole and past its respective opposing surface. The lock may include a screw extending through the sleeve into engagement with the pole.

A net system includes three poles with the center pole including at least a pair of sleeves and the two outer poles includes at least one sleeve. The pair of nets are secured to the poles by the appropriate sleeves.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
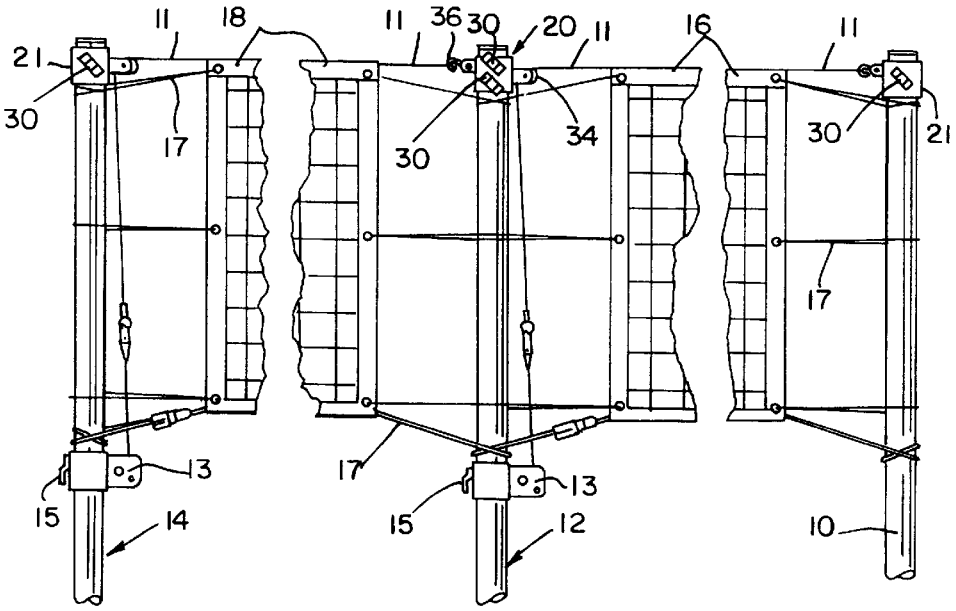
FIG. 1 is a view of a net system according to the principles of the present invention.
Figure 6:
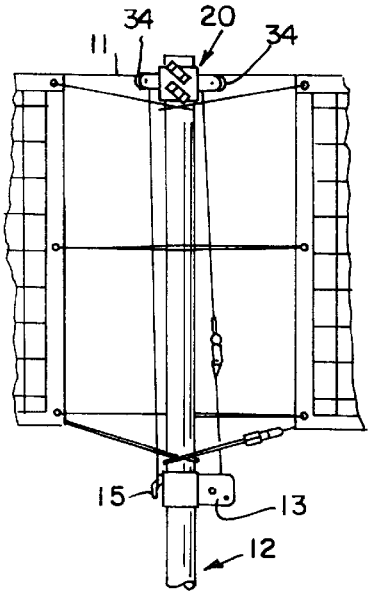
FIG. 6 is a view of a net system according to the principles of the present invention, including a pair of pulleys at the center pole.
Figure 7:
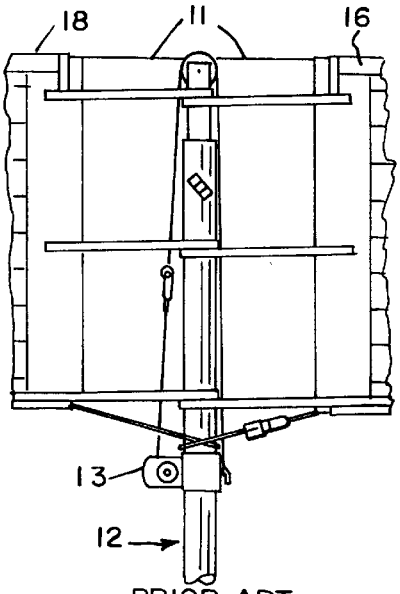
PRIOR ART FIG. 7
FIG. 7 is a view of a net system with a telescopic center pole according to the prior art.
Figure 8:
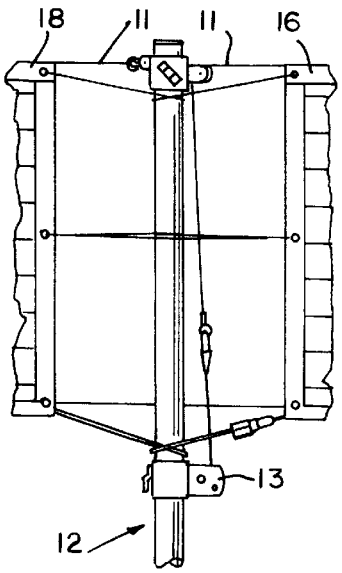
PRIOR ART FIG. 8
FIG. 8 is a view of a net system having a common adjustable sleeve of the prior art.

A net system for a pair of nets, for example, the volleyball nets, is illustrated in FIG. 1. Three poles, 10, 12 and 14 support the pair of nets 16 and 18. The upper cords 11 of the net are received by sleeves 20 and 21. One end of cords 11 are secured by a crank 13 on one of the poles, for example, 12 and 14, or a hook 36 on the sleeves. Alternative the other end of the cord 11 may be received by a pulley 34 on a sleeve and secured to the pole by a securement 19, for example, on the sleeve of crank 13, as shown in FIG. 6. Additional cords 17 connect the nets 16, 18 to the poles 10, 12, 14. Pole 12 is a common pole for both systems. A lock 30 on each sleeve 20 and 21 allows adjustment of the height of the net.

As will be explained, with respect to FIG. 24, sleeve 20 is a split sleeve made up sleeves 22 and 24, each with a lock 30 which allows a single pole 12 to support adjacent nets at the same height as well as allowing the adjustability of the height of one relative to the other. The pair of sleeves are configured such that their opposing surfaces are complementary, which allows the support surface for the cords of the net to be in a single plane. This allows a pair of nets to be at the same height.

Figure 2A:
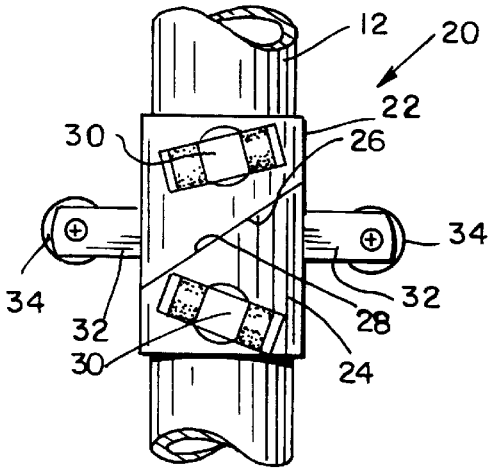
FIGS. 2A and 2B are views of a first embodiment of a split sleeve in an adjacent and separated condition respectively incorporating the principles of the present invention.
Figure 2B:
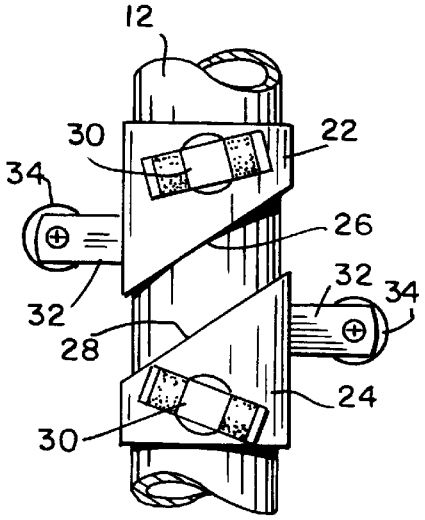

Turning to FIGS. 2A and 2B, the split sleeves 20 include sleeves 22 and 24 having opposed surfaces 26 and 28 respectfully. A lock 30 is provided on each of the sleeves 22 and 24. The lock 30 may include a screw which it extends through the sleeves 22 and 24 and engages the pole 12, for example. Other types of locks may be used to allow adjustment of the sleeves 21, 22 and 24 on the poles. An arm 32 extends from each of the sleeves transverse to the axis of the pole and supports a pulley 34. The pulley 34 or hook 36 (FIG. 1) includes and defines the net support surface.

As shown in FIG. 2A, when the two opposing surfaces 26 and 28 are engaged, the arms 32 and pulleys 34 and consequently the net support surface are planar. This allows two adjacent nets to be at the same height. As illustrated in FIG. 2B, the sleeves 22 and 24 may be separated such that adjacent nets may be at different heights. The opposing surfaces 26 and 28 of sleeves 22 and 24 have a common angle with respect to the axis of the pole 12. This common angle may be in the range of 30–60°. The illustrated angles are approximately 55°. The angle is selected to allow an area to receive the locks 30 as well as to provide support for the load carried by the arms 32.

Figure 3A:
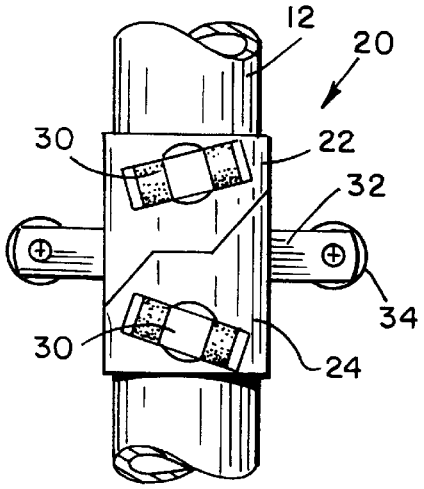
FIGS. 3A and 3B are views of a second embodiment of a split sleeve in an adjacent and separated condition respectively incorporating the principles of the present invention.
Figure 3B:
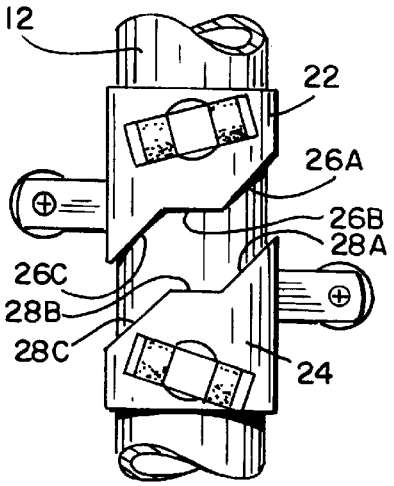
Figure 4A:
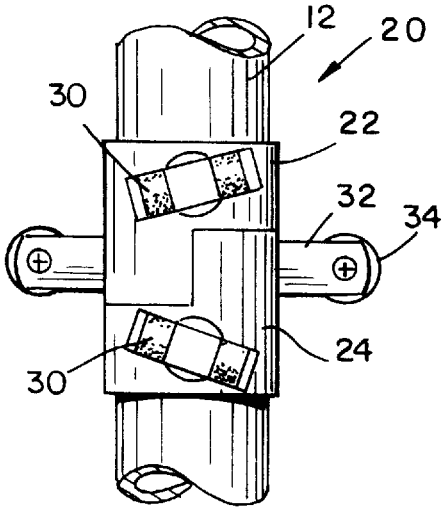
FIGS. 4A and 4B are views of a third embodiment of a split sleeve in an adjacent and separated condition respectively incorporating the principles of the present invention.
Figure 4B:
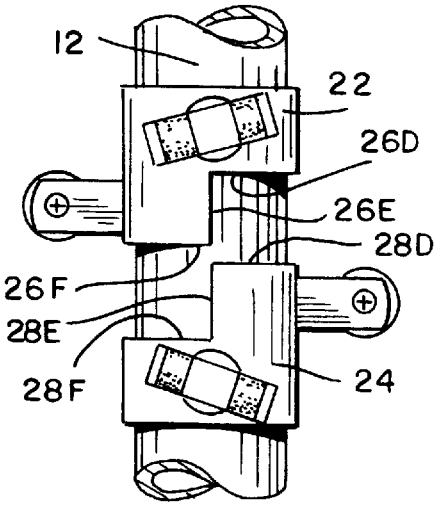

FIGS. 3A and 3B illustrate another embodiment of the sleeves 22 and 24 having opposing surfaces which are complements. Surface 26 of sleeve 22 includes segments 26A, 26B and 26B which are complements of the segments 28A, 28B and 28C of surface 28 of sleeve 24. FIGS. 4A and 4B illustrate, again, surface 26 includes line segments 26D, 26E, 26F which are complements of line segments 28D, 28E and 28F.

Figure 5A:
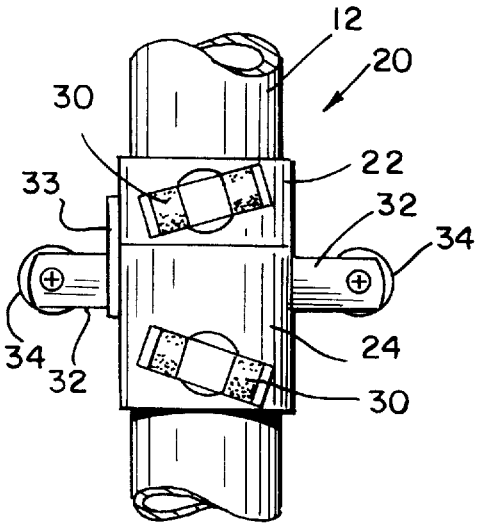
FIGS. 5A and 5B are views of a fourth embodiment of a split sleeve with an adjacent and separated condition respectively incorporating the principles of the present invention.
Figure 5B:
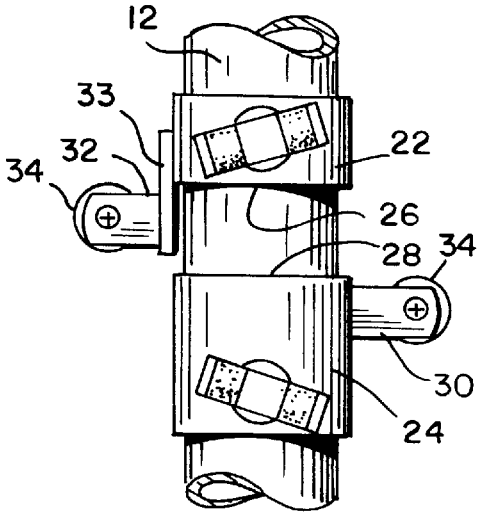

FIGS. 5A and 5B illustrate another embodiment of sleeves 22 and 24 having opposed surfaces 26 and 28 made up of a single segment which is 90° with respect to the axis of the sleeves and the pole 12. The arm 32 of sleeve 22, which supports a pulley 34 or a hook, is connected to the sleeve 22 by a portion 33. The portion 33 extends parallel to the axis of the pole and passed the opposed surface 26 of its sleeve. This allows the net support surfaces to be coplanar.

The four embodiments are just examples of the kinds of complement surfaces 26 and 28 of the sleeves 22 and 24. The surfaces also maintain the arms 32 and the pulleys 34 in a common plane running transverse to the axis of the pole. If a hook 36 is used with a pulley 34, the arms 32 do not need to be coplanar for the net support surface to be coplanar as illustrated in FIG. 1.

As will be evident, the complementary surfaces of FIGS. 2A and 2B are the simplest since it requires a single cut from a common tube, thereby insuring the complementary nature of the opposing surfaces 26 and 28. Also, the FIGS. 5A and 5B embodiment requires only a single cut to form the pair of sleeves 22 and 24 having complementary surfaces, but requires an additional element or portion 33 of the arm 32. Element 33 is welded to the sleeve 22 and the arm 32 may be an integral part of it or it may be welded to the portion 33 also.

The poles 10, 12 and 14 and the sleeves 20, 22 and 24 are illustrated as tubes, they may also be rectangular in shape or any other geometric shape. It should also be noted that although the arms 32 are shown extending opposite each other or 180° with respect to each other, and are generally in a common plane along the axis of the pole, they may be at any angle with respect to each other. The complementary surfaces 26 and 28 would then be modified to allow such angular orientation.

Although the illustration is for volleyball nets, the present support system may be for any other nets, for example, tennis. Also, the pulley 34 and hook 36 are just two devices which may provide a support surface for the net. Also, the arms 32 may be displaced with respect to each other when the complementary surfaces 26 and 28 engage. The difference in height may be compensated by a different sized pulley. This would also assure that the support surface will be coplanar when the opposing surfaces 26 and 28 engage.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A standard for a pair of sport nets comprising:

a pole;

a pair of sleeves on the pole and having opposing surfaces when adjacent;

a lock for each sleeve to lock the sleeve at vertical positions on the pole;

a net support surface on each sleeve; and the opposing surfaces of the sleeves are shaped so that the net support surfaces lie when the opposing surfaces are adjacent to each other.

2. The standard according to claim 1, wherein the opposing surfaces are at a common angle with respect to an axis of the pole.

3. The standard according to claim 2, wherein the common angle is in the range of 30 to 60 degrees.

4. The standard according to claim 2, wherein the common angle is 90 degrees.

5. The standard according to claim 1, wherein the opposing surfaces are complements.

6. The standard according to claim 5, wherein the opposing surfaces each include a plural of complementing segments.

7. The standard according to claim 1, including an arm coupling the net support surface to the sleeve.

8. The standard according to claim 7, wherein the arm extends transverse to a longitudinal axis of the pole.

9. The standard according to claim 7, wherein the arm on at least one of the sleeves includes a portion which extends parallel to a longitudinal axis of the pole from the sleeve and beyond its respective opposing surface.

10. A sport net system for a pair of nets comprising:

first, second and third pole;

a pair of sleeves on at least the second pole and having opposing surfaces when adjacent;

at least one sleeve on the first and third poles;

a lock for each sleeve to lock the sleeves at vertical positions on the pole;

a net support surface on each sleeve;

the opposing surfaces of the pair of sleeves are shaped so that the net support surfaces lie in the same horizontal plane when the opposing surfaces are adjacent to each other; and a pair of sport nets, each net coupled at first end to the net support surface on the sleeve of the second pole and at a second end to the net support surface on the sleeve of the first or third pole.

11. The system according to claim 10, wherein the lock includes a screw extending through the sleeve into engagement with the pole.

12. The system according to claim 10, wherein the opposing surfaces are at a common angle with respect to an axis of the pole.

13. The system according to claim 12, wherein the common angle is in the range of 30 to 60 degrees.

14. The system according to claim 12, wherein the common angle is 90 degrees.

15. The system according to claim 10, wherein the opposing surfaces are complements.

16. The system according to claim 15, wherein the opposing surfaces each include a plural of complementing segments.

17. The system according to claim 10, including an arm coupling the net support surface to the sleeve.

18. The system according to claim 17, wherein the arm extends transverse to a longitudinal axis of the pole.

19. The system according to claim 17, wherein the arm on at least one of the sleeves includes a portion which extends parallel to an axis of the pole past its respective opposing surface.

* * * * *

UNITED STATES PATENT AND TRADEMARK OFFICE

CERTIFICATE OF CORRECTION

PATENT NO. : 6,089,995
DATED : July 18, 2000
INVENTOR(S) : Edward A. Schroeder

It is certified that error appears in the above-identified patent and that said Letters Patent is hereby corrected as shown below:

Column 3,
Line 57, between the words “lie” and “when” insert -- in the same horizontal plane --.

Signed and Sealed this

Twenty-sixth Day of August, 2003

JAMES E. ROGAN
*Director of the United States Patent and Trademark Office*